US009371688B2

(12) United States Patent
Cavarec et al.

(10) Patent No.: US 9,371,688 B2
(45) Date of Patent: Jun. 21, 2016

(54) MOTORIZED OPERATING DEVICE INTENDED FOR OPERATING A MOVABLE SCREEN WITH A WINDABLE CANVAS OF A WINDOW COVERING DEVICE OR A PROJECTION SCREEN DEVICE

(75) Inventors: Pierre-Emmanuel Cavarec, Mont Saxonnex (FR); Sebastien Lemaitre, Cluses (FR)

(73) Assignee: SOMFY SAS, Cluses (FR)

( * ) Notice: Subject to any disclaimer, the term of this patent is extended or adjusted under 35 U.S.C. 154(b) by 0 days.

(21) Appl. No.: 13/997,087

(22) PCT Filed: Dec. 22, 2011

(86) PCT No.: PCT/EP2011/073888

§ 371 (c)(1),
(2), (4) Date: Jun. 21, 2013

(87) PCT Pub. No.: WO2012/085252

PCT Pub. Date: Jun. 28, 2012

(65) Prior Publication Data

US 2013/0269885 A1 Oct. 17, 2013

(30) Foreign Application Priority Data

Dec. 22, 2010 (FR) ..... 10 61012
Oct. 4, 2011 (FR) ..... 11 58959

(51) Int. Cl.
*A47G 5/00* (2006.01)
*E06B 9/40* (2006.01)
(Continued)

(52) U.S. Cl.
CPC ... *E06B 9/40* (2013.01); *E06B 9/64* (2013.01); *E06B 9/72* (2013.01)

(58) Field of Classification Search
CPC ..... E06B 9/64; E06B 9/40; E06B 9/56; E06B 9/54; E06B 2009/546; E06B 9/42; E06B 9/17046
USPC ..... 160/85, 86, 120, 121.1, 311, 309, 312, 160/243, 241, 242, 310, 250, 23.1, 28, 29, 160/30, 48, 49, 68, 244, 27, 66, 67
See application file for complete search history.

(56) References Cited

U.S. PATENT DOCUMENTS 1,003,045 A * 9/1911 Harthough ..... 160/121.1
3,183,033 A * 5/1965 Stulbach ..... 296/97.2
(Continued)

FOREIGN PATENT DOCUMENTS

DE 4038419 A 6/1991
DE 20303183 U 6/2003
(Continued)

OTHER PUBLICATIONS

Rau, Patent Translation of "DE 4038419". Provided by EPO. Date Accessed: Feb. 13, 2015. <http://ep.espacenet.com/>.*

*Primary Examiner* — Katherine Mitchell
*Assistant Examiner* — Johnnie A Shablack
(74) *Attorney, Agent, or Firm* — Frommer Lawrence & Haug LLP

(57) ABSTRACT

A motorized operating interior device for operating a movable interior screen with a windable canvas of a window covering device or of a projection screen device, the motorized operating interior device configured to be suspended by the canvas and including:

a winding tube which is movable around a first axis and on which the canvas is adapted to be wound, an actuator which is disposed at least in part in the tube, a first element for fixing a first end of the canvas to the winding tube, the weight of the motorized operating interior device creating a canvas unwinding torque, wherein said operating device includes an compensating element for compensating for the unwinding torque and which acts exclusively by either interaction with gravity or with the canvas or both.

33 Claims, 6 Drawing Sheets

(51) Int. Cl.
*E06B 9/64* (2006.01)
*E06B 9/72* (2006.01)

(56) References Cited

U.S. PATENT DOCUMENTS

| | | | | | |
|---|---|---|---|---|---|
| 3,464,480 | A * | 9/1969 | Kuss | 160/368.1 | |
| 3,521,693 | A * | 7/1970 | Kuss | A47H 5/00 160/243 | |
| 3,537,504 | A * | 11/1970 | Deane | E06B 9/58 160/243 | |
| 3,980,122 | A * | 9/1976 | Takazawa | E06B 9/64 160/120 | |
| 4,480,675 | A * | 11/1984 | Berkemeier | 160/121.1 | |
| 5,195,594 | A * | 3/1993 | Allen et al. | 169/48 | |
| 5,383,510 | A * | 1/1995 | Allen | 160/310 | |
| 5,524,693 | A * | 6/1996 | Hamilton | 160/243 | |
| 5,785,105 | A * | 7/1998 | Crider et al. | 160/243 | |
| 5,960,847 | A * | 10/1999 | Crider | E06B 9/13 160/121.1 | |
| 6,111,376 | A * | 8/2000 | Jean-Marc | 318/432 | |
| 6,135,534 | A * | 10/2000 | Schmeichel | 296/98 | |
| 6,138,739 | A * | 10/2000 | Crider et al. | 160/273.1 | |
| 6,176,028 | B1 * | 1/2001 | Walsh et al. | 40/514 | |
| 6,401,794 | B1 * | 6/2002 | Hamilton | 160/243 | |
| 6,834,701 | B2 * | 12/2004 | Colson | E06B 9/262 160/121.1 | |
| 6,942,001 | B1 * | 9/2005 | Crider et al. | 160/241 | |
| 7,028,742 | B2 * | 4/2006 | Sears et al. | 160/310 | |
| 7,089,991 | B2 | 8/2006 | Jorgensen et al. | | |
| 7,264,034 | B2 | 9/2007 | Lin | | |
| 7,350,556 | B2 * | 4/2008 | Pernicano | 160/243 | |
| 7,735,539 | B2 * | 6/2010 | Nakamura et al. | 160/243 | |
| 7,806,160 | B2 * | 10/2010 | Byeon | E06B 9/40 160/11 | |
| 8,439,099 | B1 * | 5/2013 | Crider | 160/121.1 | |
| 2005/0072532 | A1 | 4/2005 | Holden et al. | | |
| 2010/0258255 | A1 * | 10/2010 | Lee | E06B 9/42 160/319 | |
| 2010/0294440 | A1 * | 11/2010 | Li et al. | 160/310 | |
| 2011/0036511 | A1 * | 2/2011 | Dempwolffe | 160/84.02 | |
| 2014/0202643 | A1 * | 7/2014 | Hikmet et al. | 160/5 | |
| 2015/0136338 | A1 * | 5/2015 | Lemaitre | E06B 9/72 160/310 | |
| 2015/0179994 | A1 * | 6/2015 | Lemaitre | E06B 9/72 160/310 | |

FOREIGN PATENT DOCUMENTS

| | | | | |
|---|---|---|---|---|
| FR | EP 0683302 | A1 * | 11/1995 | E06B 9/40 |
| GB | 2050641 | A * | 1/1981 | E06B 9/64 |
| WO | WO 02/41740 | A | 5/2002 | |

* cited by examiner

MOTORIZED OPERATING DEVICE INTENDED FOR OPERATING A MOVABLE SCREEN WITH A WINDABLE CANVAS OF A WINDOW COVERING DEVICE OR A PROJECTION SCREEN DEVICE

This application is a 371 of PCT/EP2011/073888 filed on Dec. 22, 2011, published on Jun. 28, 2012 under publication number WO 2012/085252, which claims priority benefits from French Patent Application Number 1061012 filed Dec. 22, 2010 and French Patent Application Number 1158959 filed Oct. 4, 2011, the disclosures of both are incorporated herein by reference.

The invention concerns a movable screen with a windable canvas, of the window covering or projection screen type, provided with a motorized winding means and in which the motorized winding means is displaced vertically when said winding means is electrically activated. The invention is concerned more precisely with a motorized operating device which is intended for operating a movable screen with a windable canvas of a window covering device or a projection screen device and with a window covering device or a projection screen device which includes such an operating device.

A movable screen with a windable canvas is described in U.S. Pat. No. 7,089,991. Synchronized drive means disposed at the two ends of a load bar cooperate with rails provided with rack gearing. The screen is fixed to the load bar by way of a first end, and by way of a second end to a winding tube which is provided with a winding spring and is disposed in a top box.

Said arrangement requires two motorized means: the one being electric in the load bar, the other being mechanical in the winding tube. In addition, it requires a connection between the load bar and the frame, that is to say, in this case, slides provided with rack gearing.

Other movable screens where the motorized winding means are displaced vertically do not require two motorized means but are concerned with the winding of a cord. The movable screen is the Venetian blind type, as described in U.S. Pat. No. 7,264,034. The movable screen piles up more or less above a motorized load bar, including winding means for a cord fixed on a top box and power supplying means in the form of batteries.

Patent application WO 02/41740, in FIG. 6, also describes this type of configuration, in which the drive mechanism is contained in the bottom rail of a cell-type or accordion-type solar protection system. This time once again, the winding of the cord causes the load bar to rise and the folds making up the solar protection to stack up progressively as the rise occurs.

Said two documents are not concerned with a movable screen with a windable canvas and in no way anticipate a possibility for winding the solar protection system around the motorized winding means.

The problem raised by winding the canvas directly on the motorized winding means is that of the compensation of torque, as explained in connection with FIG. 1 of the present application. Said problem does not occur in U.S. Pat. No. 7,089,991 as a result of using a connection between the winding means and the frame. Said problem does not arise in the case of the other documents quoted as prior art as a result of using an actual bottom box (or rail) to contain the motorized winding means. The winding of the cord is produced there with contiguous turns, as shown in the figures of said documents. Moreover, the strips or folds are deposited regularly on a top face of the bottom box and do not introduce any imbalance on the bottom box.

The invention aims to allow the canvas to wind directly on the motorized winding means and solely on said means, which necessitates the compensation of a variable tilting torque according to the winding of the canvas and the ability to avoid the unwinding of said canvas when the motorized winding means is not activated.

The object of the invention is to supply a device for operating a screen, finding a solution to the disadvantages mentioned and improving operating devices known in the prior art. In particular, the invention proposes an operating device of simple structure which does not require any lateral guiding means and a compensation of torque which does not require action on the frame on which the screen is mounted.

According to the invention, the motorized operating device is intended for operating a movable screen with a windable canvas of a window covering device or a projection screen device. The motorized operating means is intended to be suspended by the canvas and includes:

- a winding tube which is movable around a first axis and on which the canvas is intended to be wound,
- an actuator which is disposed at least in part in the tube,
- a first means for fixing a first end of the canvas to the winding tube.

The weight of the operating device creates a canvas unwinding torque. The device includes a means for compensating the unwinding torque which acts exclusively by interaction with gravity and/or with the canvas.

The means for compensating the unwinding torque can act by the application of a force of the canvas on said means and/or by the application of the weight of a mass of said means.

The actuator can include a first part and a second part which are made to rotate with respect to one another along the first axis when the actuator is activated and are blocked with respect to one another when the actuator is not activated, the first part rotating integrally with the winding tube and the second part of the motor being connected to the compensating means.

The second part can include an output shaft of the actuator.

The second part can be a housing of the actuator.

The compensating means can include at least one lateral element, which is connected to the second part on the outside of the winding tube and extends at least approximately at right angles to the first axis over a distance which is in excess of the largest winding radius of the canvas when the canvas is completely wound on the winding tube.

The compensating means can include a roller, which is mounted on a free shaft so as to be movable around a second axis which is parallel to the first axis, and is connected to the lateral element at a distance from the first axis which is in excess of the largest winding radius, the roller being in contact with an outside surface of the canvas, at least when the actuator is not activated, and the unwinding torque being at least counterbalanced by the force of the canvas on the movable roller.

The compensating means can include an additional mass which is connected to the lateral element at a distance from the first axis which is in excess of the largest winding radius, the equilibrium of the unwinding torque being brought about by the torque created by the weight of the lateral element and of the additional mass and not necessitating any contact between the compensating means and the canvas.

The additional mass can include a photovoltaic-type panel and/or a store of electric energy.

The lateral element can be fixed to an approximately cylindrical section along a radius which is in excess of the largest unwinding radius, surrounding the unwinding tube and provided with a slot which is parallel to the first axis.

The section can include an edge which is intended to abut, notably with friction, against the canvas.

The motorized device can include a photovoltaic panel which is fixed on the section.

The section can include a channel for guiding an electric cable.

The motorized device can include a bar which is fixed to the lateral element.

The bar can include an edge intended to abut, notably with friction, against the canvas.

The motorized device can include a photovoltaic panel which is fixed on the bar.

The bar can include a channel for guiding an electric cable.

The motorized device can include a rod which is fixed to the lateral element, the rod being intended to abut against the canvas.

The motorized device can be intended to be in contact or in connection with just the canvas.

The winding tube can be realized in plastics material.

The motorized device can include resilient means at the bearings for guiding the winding tube, for example, annular bands between the lateral elements and the winding tube.

The lateral element can include an end-plate.

The motorized device can include a second means for fixing a second end of the canvas to the means for compensating the unwinding torque.

According to the invention, the window covering device or screen device, notably projection screen device, includes an operating device defined previously and a movable screen which includes a canvas.

The window covering device or screen device can include a second means for fixing a second end of the canvas to a fixed frame.

The window covering device or screen device can include a canvas return tube, the return tube being freely rotatable around a third axis which is parallel to the first axis.

The invention will be better understood by reading the description below, given solely by way of example and done with reference to the accompanying drawings, in which.

Figure 1:
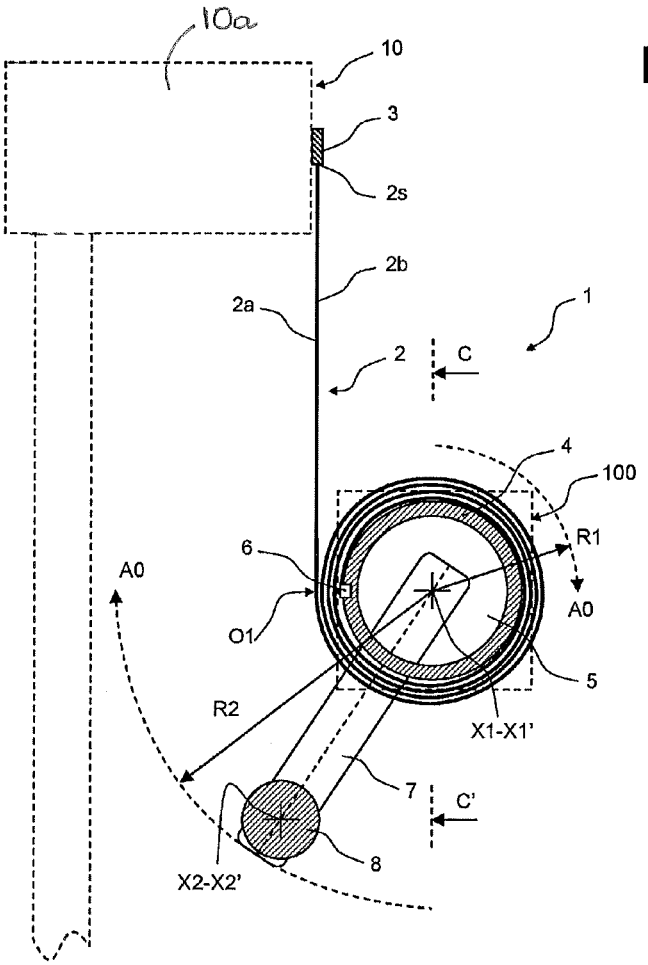
FIG. 1 shows a cross section of a window covering device or a projection screen device, disposed on a frame, according to a first embodiment of the invention.

FIG. 1 shows a cross section of a window covering device 1 or projection screen device 1, disposed on a frame 10, shown according to a first embodiment of the invention. The window covering device 1 or projection screen device includes a movable screen with a windable canvas 2 and a motorized operating device 100 intended for operating the windable canvas 2. The canvas is fixed to the frame by a second means 3 for fixing a top end of the canvas.

The motorized operating device includes:

- a winding tube 4 which is movable around a first axis X1-X1' and on which the canvas is intended to be wound,
- an actuator 5 which is disposed at least in part in the tube,
- a first means 6 for fixing a first end of the canvas to the winding tube.

The motorized device is intended to be connected to the frame 10 exclusively by the canvas. In particular, the motorized device is intended to be suspended exclusively by the canvas. Thus, all the compensation of stresses exerted on the motorized operating device is provided by the canvas. Said canvas, moreover, is mechanically connected to the frame. The window covering device or projection screen device according to the invention is intended to be solely connected to the building that it equips by the end of the canvas. There is no other contact or connection between the window covering device or the screen device and the building. As a result, the motorized device, itself, is intended to be solely connected to the canvas. There is no contact or connection between the motorized device and the building. Thus, in a very efficient manner it is possible to reduce the vibrations transmitted to the structure of the building.

In particular, said configuration of the motorized device suspended solely by the canvas and without any other contact with the frame notably provides the following advantages: lack of friction, sliding, rolling and even rebounding of the canvas (or of any other element of the motorized device) on the frame. Because of this, the canvas is preserved from possible deterioration caused by contact with the frame or from wear and tear or from premature ageing. Said configuration also allows the transmission of structure-borne noises toward the frame to be avoided.

Furthermore, it allows a configuration of taut, vertical canvas to be obtained. Insofar as said installations are intended for solar protection from the inside of the building, contact with the frame is also not necessary to hold the motorized device in the rest position.

To avoid any detrimental contact between the motorized device and the frame (or another element fixed on the frame, like a window frame for example), the canvas must be held at its top end on the frame by means of a support or a distance-piece 10*a*, the length of which, taken at right angles to the frame, is at least in excess of the maximum winding radius, even at least in excess of the radius of a housing surrounding the wound canvas. In all cases, the support of the canvas on the frame is such that it allows the canvas to unwind without any contact with the frame.

A bottom end of the canvas is fixed by the first fixing means 6 to the winding tube 4 which contains, at least in part, the actuator 5. In FIG. 1, the actuator is shown cut away. Two variants of the design of the actuator 5 are described further below in connection with FIGS. 7 and 8.

The winding tube and the actuator have a same first axis of rotation, marked as X1-X'1, at right angles to the plane of FIG. 1 and shown by a cross. The reference R1 is given to the largest winding radius of the canvas, that is to say when the canvas is fully wound on the winding tube.

FIG. 1 shows a configuration where the canvas is partly wound on the winding tube. At said stage, it is understood that, as a result of gravity and therefore notably of the weight of the winding tube, of the wound canvas and of the actuator, there is tilting torque or unwinding torque which tends to cause the assembly to rotate in the direction shown by an arrow A0, and therefore tends to bring about the unwinding of the canvas.

It must be noted that said tilting torque or unwinding torque is not constant for two cumulative reasons: it increases together with the mass of wound canvas and with the diameter of the winding.

Now it is in the interest of the designer for the total mass of the winding tube and of the actuator not to be too great so as to minimize the power consumption during a winding operation. Said mass must not be too light either so as to ensure the canvas is properly tensioned, with no visible folds. It is possible, therefore, to have situations where the mass of the canvas is the same size as the total mass of the winding tube and of the actuator, that is to say producing a variation where the mass can double between a completely unwound situation and a completely wound situation.

In addition, it is necessary for the diameter of the tube not to be too large so as, at the same time, to avoid a visual disturbance in an intermediate stop position, to avoid a raised reduction ratio in the members of the actuator and to avoid a very high cost for materials. The result is that the variation in diameter can be significant between a completely unwound situation and a completely wound situation, for example an increase of 150%.

In total, the tilting torque can vary, for example, by a ratio of 1:3, which is considerable.

To counter said tilting torque or unwinding torque, the motorized operating device is provided with a stop means or means for compensating the unwinding torque.

In a manner which will be given in more detail further below, the actuator 5 is connected to the lateral element 7, on the outside of the winding tube. The lateral element extends at least approximately at right angles to the first axis, along a lateral direction shown by a straight dotted line, over a distance R2 which is in excess of the largest winding radius of the canvas. For example, the distance R2 is at least double the largest winding radius R1.

In addition, an additional mass 8 is also connected to the lateral element 7, preferentially as far as possible from the first axis, the centre of gravity of which is at least at a distance R3 which is in excess of the largest winding radius.

Preferentially, the additional mass has a cylindrical form (with some kind of base, for example: elliptical, circular or rectangular) along a second axis marked as X2-X2' which is parallel to the first axis.

According to the first embodiment, the stop means is constituted by the lateral element and by the additional mass. Its operation is given in detail in FIG. 2.

Figure 2:
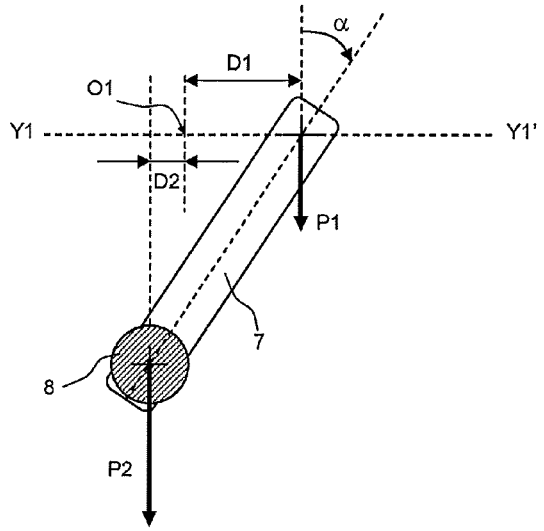
FIG. 2 shows the forces acting on the elements of the window covering device or projection screen device according to the invention.

FIG. 2 shows the forces acting on the elements of the motorized operating device at the first axis and the second axis in the situation in FIG. 1. It is supposed for simplification that the mass of the lateral means is insignificant in comparison to the mass of the winding tube, of the actuator, of the wound canvas and of the additional mass. It is also supposed that the centre of gravity of the additional mass is situated along the second axis.

In said conditions, a first weight P1 corresponds to the action of gravity on the mass of the winding tube, the mass of the actuator and the mass of the wound canvas. A second weight P2 corresponds to the action of gravity on the additional mass. The reference D1 refers to the current value of the winding radius and the reference O1 refers to a point on a horizontal axis Y1-Y1', at right angles and intersecting the first axis, situated at the end of the winding radius. Finally, the reference D2 refers to the distance between the point O1 and a vertical line passing through the second axis.

The point O1 is the centre of rotation.

The tilting torque C1 is equal to the product of P1 by the distance D1. Said tilting torque is counterbalanced by an antagonistic torque C2, equal to the product of P2 by the distance D2, if the following statement is verified:

$$P1 \times D1 = P2 \times D2$$

As the second weight P2 has a constant value, it is the value of the distance D2 which serves as an adjustment variable so that said statement is verified for a given torque of the first weight and of the current value of the winding radius. Said adjustment is made automatically by varying an angle $\alpha$ between the vertical and the lateral direction: the more the mass of wound canvas increases and the more the current value of the winding radius increases, the more it is necessary for D2 to increase and the lateral direction tends to approach the horizontal. The device according to the invention is therefore suited, if it is correctly dimensioned, to compensating automatically the cumulative variation of wound mass and of winding radius.

To dimension the device, the designer ensures that the preceding statement can be verified under all circumstances and, for example, that the first weight P1 remains lower, for a maximum winding, than the value given by said statement when the lateral direction becomes horizontal. If this is not the case, the designer increases the mass of the additional mass or the distance R2.

It is also possible to provide a means for adjusting the position of the additional mass along the lateral element in the case where it must be possible to use a same device with canvasses of very different densities.

Figure 3:
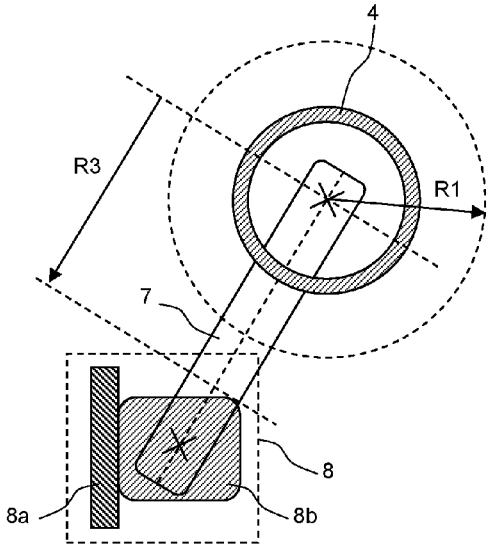
FIG. 3 shows a cross section of a variant of the first embodiment of the window covering device or projection screen device according to the invention.

FIG. 3 shows a cross section of a variant of the first embodiment. Said variant concerns the nature of the additional mass 8, constituted in this case by a photovoltaic-type panel 8*a* and by an energy storage means 8*b*, in the form of an accumulator battery or in the form of super-capacitor banks. The electric connections are not shown. An electric connection to the actuator is established by using the lateral element as support for the electric conductors. As an alternative, only the storage means is used, in the form of primary batteries.

Figure 4:
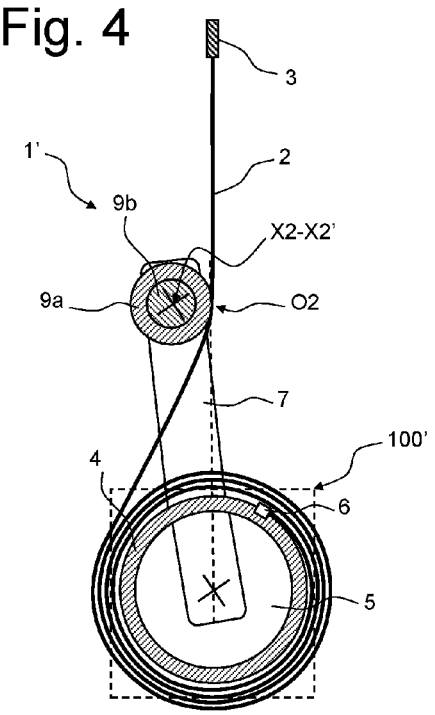
FIG. 4 shows a cross section of a second embodiment of the window covering device or projection screen device according to the invention.

FIG. 4 shows a cross section of a second embodiment of the window covering device 1' or projection screen device according to the invention. In said second embodiment, the window covering device 1' or projection screen device, as in the first embodiment and with the same references, includes a windable canvas 2 which is fixed to the frame (not shown) by a first fixing means 3 of a top end of the canvas, and a motorized operating device 100' which is intended for operating the canvas. As in the first embodiment, a bottom end of the canvas is fixed by means of a second fixing means 6 to a winding tube 4, which contains at least in part an actuator 5 (shown cut away). The actuator 5 is connected to a lateral element 7, outside of the winding tube. Contrary to this, in said second embodiment of the motorized operating device 100', the torque compensating means is different. The movable mass 8 is replaced by a roller 9*a*. Thus, the compensating means includes the roller 9*a* which is mounted on a free shaft 9*b* which is movable around the second axis X2-X2' as previously defined.

In said embodiment, the weight of the tube, the wound canvas and the actuator is not counterbalanced when the situation of the lateral element is that in FIG. 1: as a result of the tilting torque, there is therefore rotation in the direction of the arrow A0, the horizontal position of the lateral element is exceeded and the tilting is continued up to contact (at the point O2) between the roller and the outer part of the canvas. The reaction of the canvas therefore counterbalances the tilting torque.

Figure 5:
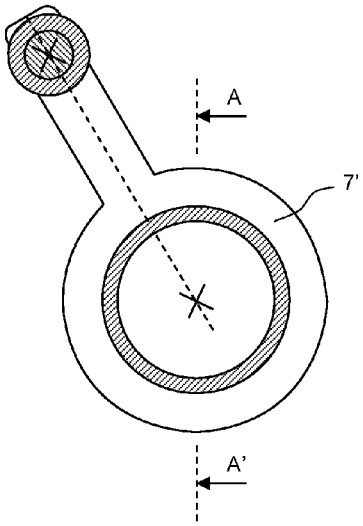
FIG. 5 shows a cross section of a first variant of the second embodiment of the window covering device or projection screen device according to the invention.

FIG. 5 shows a cross section of a first variant of the second embodiment.

Said variant concerns a second lateral element 7' which is realized in the form of an end-plate, so as to mask and protect the lateral parts of the winding, and possibly to guide the same in the event of an obstacle causing a change in the proper running of the winding operation.

Figure 6:
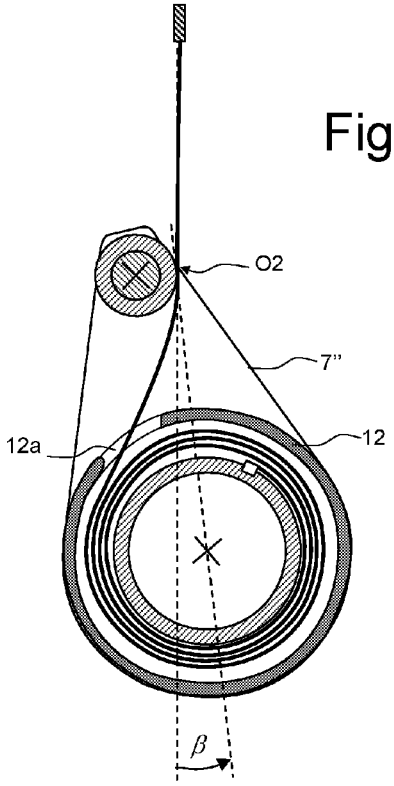
FIG. 6 shows a cross section of a second variant of the second embodiment of the window covering device or projection screen device according to the invention.

FIG. 6 shows a cross section of a second variant of the second embodiment. Said figure differs from the two previous ones by the geometry of the lateral element which is realized in the form of an end-plate 7" and by the presence of an approximately cylindrical section 12 along a radius in excess of the largest winding radius, surrounding the winding tube and provided with a slot 12*a* which is parallel to the first axis, the canvas being engaged in said slot. In a preferred manner, said section is fixed to the lateral element 7". The lateral direction joining the first axis to the second axis is approximately vertical. A small angle β has been shown between said direction and the vertical, the tilting torque resulting from this therefore being counterbalanced by the reaction of the canvas at the point of contact O2 between the canvas and the roller.

Figure 7:
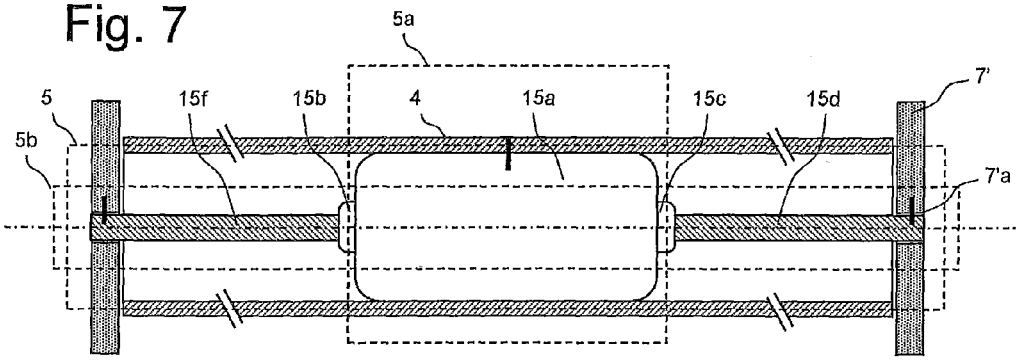
FIG. 7 shows a longitudinal section of a first variant of an actuator of the motorized movable screen and its connections to a winding tube and with a stop means according to the invention.

FIG. 7 shows a longitudinal section AA' of a first variant of an actuator 5 of the motorized movable screen and its connections to the winding tube 4 and to the lateral element 7' associated with the stop means according to the invention.

The actuator 5 includes a first part 5*a* which rotates integrally with the winding tube. The first part is, for example, a gear motor housing 15*a*. An integral connection is shown by a short segment in bold. The actuator 5 includes a second part 5*b*, which is driven in rotation in relation to the first part when the actuator is activated and is blocked in relation to the first part when the actuator is not activated. The second part includes, for example, a first output shaft 15*b* and a second output shaft 15*c*, each being connected to each lateral element, for example, by a polygonal rod, respectively 15*d* and 15*f*. A lateral element 7' includes, for example, a polygonal hole 7'*a* in which the polygonal rod engages. The lateral element therefore rotates integrally with the output shaft.

Figure 8:
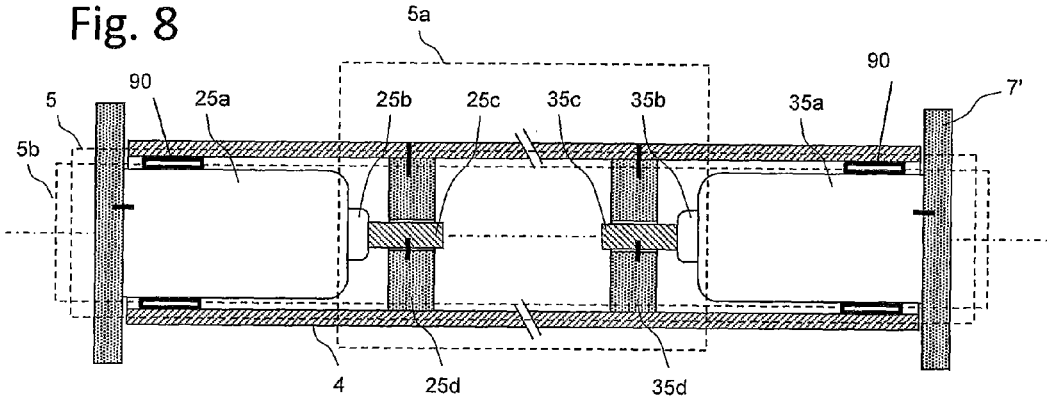
FIG. 8 shows a longitudinal section of a second variant of an actuator of the motorized movable screen and its connections to the winding tube and with the stop means according to the invention.

FIG. 8 shows a longitudinal section AA' of a second variant of an actuator 5 of the motorized movable screen and its connections to the winding tube 4 and to the lateral element 7' which is associated with the stop means according to the invention. Said variant is applicable to the case where a gear motor only includes one single output shaft. A gear motor is housed in each end of the winding tube.

A first part 5*a* of the actuator rotates integrally with the winding tube and includes, for example, a first output shaft 25*b* of the first gear motor, connected to a polygonal rod 25*c* which is engaged in a first wheel 25*d* which rotates integrally with the winding tube, and includes a second output shaft 35*b* of the second gear motor, connected to a polygonal rod 35*c* which is engaged in a second wheel 35*d* and rotates integrally with the winding tube 4. Each motor gear housing (respectively 25*a* and 35*a*) is connected to a lateral element. For example, the housing 35*a* of the second gear motor is integral with the lateral element 7'.

In said variant, the gear motors are connected electrically so as to cooperate and share the mechanical power.

Said variant is shown in the case where two gear motors are used, but it is also applicable to the case where one single gear motor is used. For example, the first gear motor is housed at a first end of the winding tube whilst a battery is housed in a second end of the winding tube, thereby replacing the second gear motor. Such an arrangement allows the masses to be distributed along a longitudinal direction.

Figure 9:
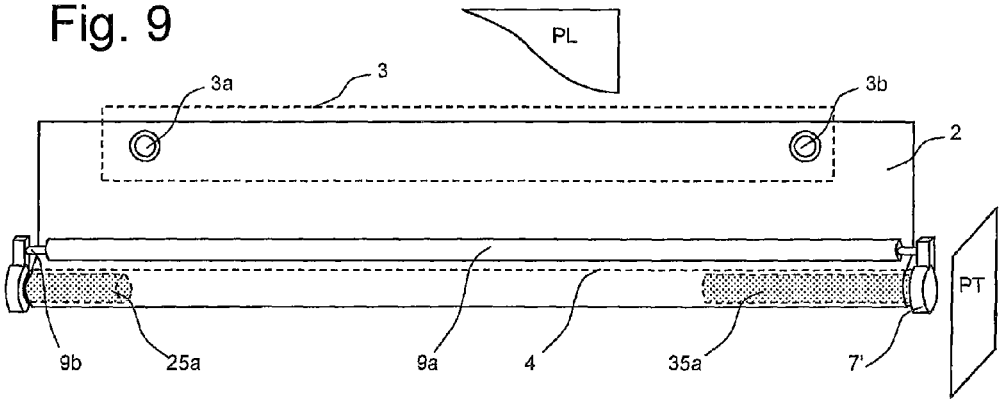
FIG. 9 shows a perspective view of a motorized movable screen, according to the second embodiment of the window covering device or projection screen device according to the invention.

FIG. 9 shows a perspective view of a window covering device 1' or projection screen device 1' according to the second embodiment of the invention. The longitudinal plane PL corresponds to the plane of FIGS. 7 and 8, whilst the cross plane PT corresponds to a plane which is parallel to the cutting planes of FIGS. 1 to 6. The roller 9*a* is mounted on the free shaft 9*b*, which is itself fixed between the two lateral elements 7'.

The energy storage element can be disposed in the roller or in the winding tube. The free shaft can also be hollow and include a means for electric connection between the two motors. The gear motor housing 35*a* is shown to be longer than the gear motor housing 25*a* as it also includes a radio frequency receiver to receive and interpret control instructions. As seen previously, the first gear motor can be housed in a first end of the winding tube whilst a battery is housed in a second end of the winding tube, thereby replacing the second gear motor. Such an arrangement allows the masses to be distributed along a longitudinal direction.

Finally, the unwinding torque compensating means acts exclusively by interaction with gravity in the first embodiment and by interaction with the canvas in the second embodiment. Said two embodiments can be combined in an advantageous manner. For example, a first lateral element can support an additional mass whilst a second lateral element supports a roller which is mounted on a free shaft, said roller being in contact with the canvas. The two lateral elements are at an angle such that gravity applied to the additional mass reduces the contact pressure between the roller and the canvas. Said combination of the two embodiments therefore allows the reaction of the canvas on the roller to be limited. In a simplified embodiment, the roller can be replaced by another element like a fixed rod, a bar, or even any other section, when the friction between the canvas and said other element is sufficiently low.

In the different embodiments, the compensation of torque is adapted to the winding direction of the canvas. The torque compensating means can be situated at the front of the canvas (visible by a user inside the building) or at the back of the canvas (hidden from the user by the canvas itself). In the case where the torque compensation means supports a photovoltaic panel, it is more advantageous for said panel to be turned toward the outside, that is to say toward the window in the case of an inside blind. In said case, the direction of winding the canvas is chosen such that the torque compensation means is turned toward the outside (toward the window). Said configuration direction is the preferred direction. In fact, in its suspended configuration, the motorized device tilts lightly in relation to the vertical axis of the canvas (the rotational axis of the tube moves in relation to the vertical plane in which the canvas extends). As a result, in the preferred configuration direction, the winding tube moves away from the frame and thus minimizes the possibilities for contacting the frame. However, the other assembly direction is totally conceivable, with an appropriate length supporting the canvas on the frame. In all cases, the choice can be left to the user in accordance with his own aesthetic criteria.

Figure 10:
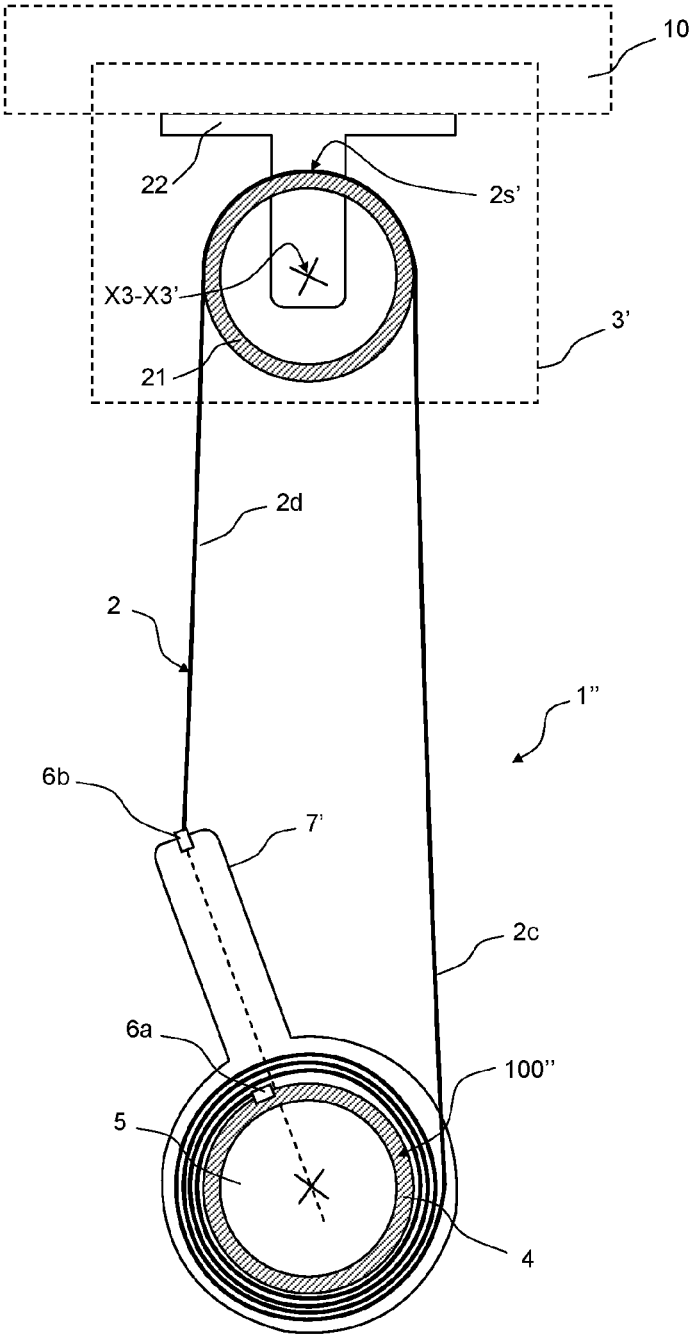
FIG. 10 shows a cross section of a third embodiment of the window covering device or projection screen device according to the invention.

FIG. 10 shows a cross section of a third embodiment of a window covering device or projection screen device according to the invention.

It differs principally from the two first embodiments in that the end of the canvas not connected to the winding tube is not fixed to a frame, but is fixed to the lateral element 7' by a second fixing means 6*b*, for example in the form of a rod disposed in a hem of the canvas and inserted at each end in each lateral element 7'. The other end of the canvas is fixed as previously to the winding tube 4 by a first fixing means 6*a*.

Between said two ends fixed to the motorized operating device 100", the canvas is wound in a U-shaped manner around a return tube 21, which rotates freely around a third axis X3-X3' which is parallel to the first axis. Said return tube is, for example, connected to the frame 10 by a fixing means such as a bracket 22 on both sides of the return tube.

The canvas therefore includes an ascending part 2*c* and a descending part 2*d* which are situated on both sides of the return tube. The inclination of the lateral element is adjusted automatically in terms of the winding radius of the canvas on the winding tube. The tension of the canvas on the second fixing means cancels out the tilting torque. Said second fixing means 6*b* therefore is part, with the lateral element, of the torque compensating means for said embodiment.

In said embodiment, the density of the canvas is divided by 2 if a same solar protection effect is wanted, which compensates for the doubling of the length of the canvas compared to the two first embodiments. Furthermore, as is known from the prior art, the canvas can comprise a regular alternating of zones with a large density and zones with a small density, producing a different visual effect or a different solar protection depending on whether the horizontal zones of the ascending part and of the descending part are staggered vertically or in alignment.

A fourth embodiment of the motorized device 200 is described below with reference to FIG. 11. Said fourth embodiment is fairly similar to the second variant of the second embodiment. In fact, the fourth embodiment includes a cylindrical section 212 (in the mathematical sense of the term) which surrounds the winding tube and is provided with an opening 217 which is parallel to the first axis and in which the canvas engages. In a preferred manner, said section is fixed to the lateral element 7'. The fourth embodiment differs nevertheless from said variant in that the section includes an edge 212*a* which is intended to bear against the canvas in order to ensure the torque compensation. In a preferred manner, said edge is positioned at a distance from the first axis, for example at a minimum of once the diameter of the winding tube or at a minimum of 5 cm or at a minimum of 10 cm. In a preferred manner, the section of the section includes a first part 218 which surrounds the winding tube and the canvas and a second part 219 which, as the first end, has the edge 212*a* and is connected to the first part at its second end. The outer surface 216 or face formed by said second part can be plane. This may also be a controlled surface which has a concavity and/or a convexity. In a preferred manner, said surface is used for setting up a photovoltaic panel 215. Advantageously, the photovoltaic panel 215 is fixed on said surface. To do this, said section and therefore the section are dimensioned such that the inclination of the photovoltaic panel fixed to the section can be optimum when the motorized device is suspended by the canvas without any contact with the frame.

In a preferred manner, a channel 214 is realized on the section, in particular on an inner face of the section, for example between the section and an unwound part of the canvas. Said channel allows a cable 213 to be passed through. Said cable allows a battery, which is situated at a first end of the winding tube, to be connected electrically to an electric motor which is situated at a second end of the winding tube.

In said embodiment, the unwinding torque of the canvas is counterbalanced by the reaction of the canvas at the contact point between the canvas and the edge 212*a* of the section.

In said embodiment, the section provides a housing function, a torque compensation function, possibly a guiding function for an electric cable and possibly a supporting function for a photovoltaic panel. The section is realized, for example, in plastics material.

A housing surrounding the canvas allows said canvas to be protected from possible stains or from the sun itself which could have an effect on the colours of the canvas. It possibly allows the motorized device to be protected from dangerous operation. Risk of pinching between different moving parts can also be minimized, in particular when the motorized device includes a motor cut-off means in the event of an obstacle being detected.

The covering device 201 includes such a motorized device and a movable screen which comprises the canvas.

A fifth embodiment of the motorized device 300 is described below with reference to FIG. 12. Said fifth embodiment differs principally from the fourth embodiment in that it does not include a section which provides the housing function. In contrast, a bar 312 is fixed to the lateral elements 307. In a preferred manner, said bar is hollow and the lateral elements are fixed on the inside of said bar. The bar includes at least one edge 319 which is intended to bear against the canvas in order to ensure the torque compensation. In a preferred manner, said edge is positioned at a distance from the first axis, for example at a minimum of once the diameter of the winding tube or at a minimum of 5 cm or at a minimum of 10 cm.

The bar has, for example, a rectangular section. The bar includes a surface 316 which can be used to set-up a photovoltaic panel 315. In an advantageous manner, the photovoltaic panel 315 is fixed on said surface 316. The bar is preferentially arranged such that the inclination of the photovoltaic panel fixed to the bar is able to be optimum.

In a preferred manner, a channel 314 is realized in the bar. Said channel allows a cable 313 to be passed through. Said cable allows a battery, which is situated at a first end of the winding tube, to be connected electrically to an electric motor which is situated at a second end of the winding tube.

In said embodiment, the unwinding torque of the canvas is counterbalanced by the reaction of the canvas at the contact point between the canvas and the edge 312 of the bar.

In said embodiment, the bar provides a torque compensation function, possibly a guiding function for an electric cable and possibly a supporting function for a photovoltaic panel.

The covering device 301 includes such a motorized device and a movable screen which comprises the canvas.

A sixth embodiment of the motorized device 400 is described below with reference to FIG. 13. Said sixth embodiment differs principally from the fifth embodiment in that the bar 412 does not provide the torque take-up. However, it includes a surface 416 which can be used for setting up a photovoltaic panel 415. In a preferred manner, a channel 414 is realized in the bar. Said channel allows a cable 413 to be passed through.

Moreover, the motorized device includes a rod 417 which is fixed to the lateral elements and provides the torque compensation. This allows, notably, the functions of supporting the photovoltaic panel and taking up the stresses to be separated. Thus, each of the functions is able to be optimized with fewer constraints.

In a preferred manner, the rod is positioned at a distance from the first axis, for example at a minimum of once the diameter of the winding tube or at a minimum of 5 cm or at a minimum of 10 cm.

In said embodiment, the unwinding torque of the canvas is counterbalanced by the reaction of the canvas at the contact point between the canvas and the rod.

In said embodiment, the rod provides a function of torque compensation. The bar possibly provides a guiding function for an electric cable and possibly a function of supporting the photovoltaic panel.

The covering device 401 includes such a motorized device and a movable screen which comprises the canvas.

Figure 11:
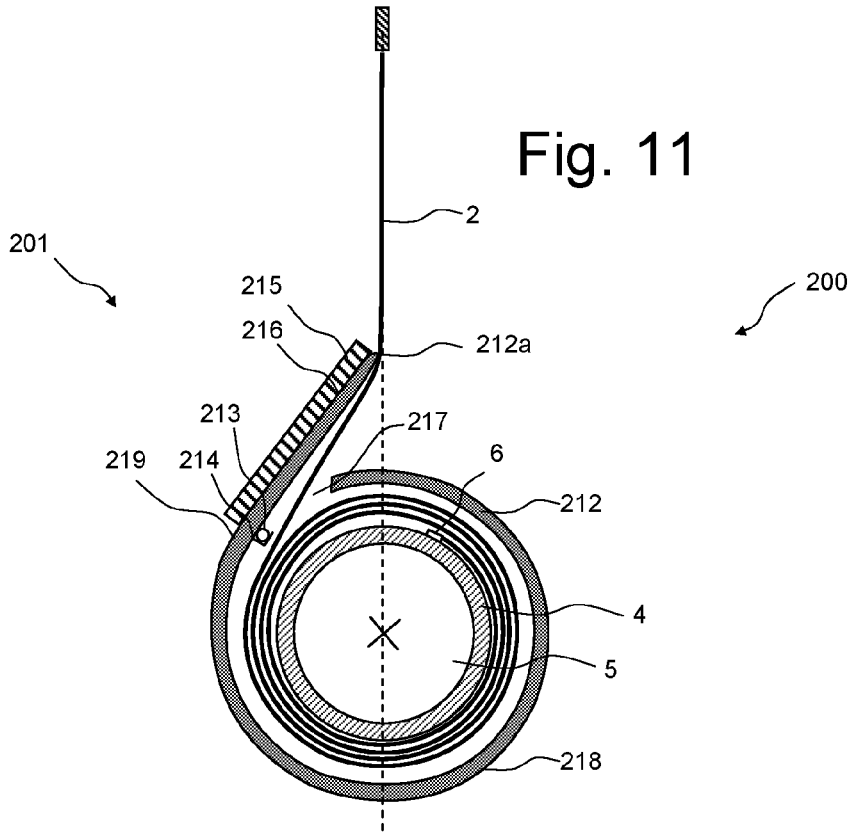
FIG. 11 shows a cross section of a fourth embodiment of the window covering device or projection screen device according to the invention.
Figure 12:
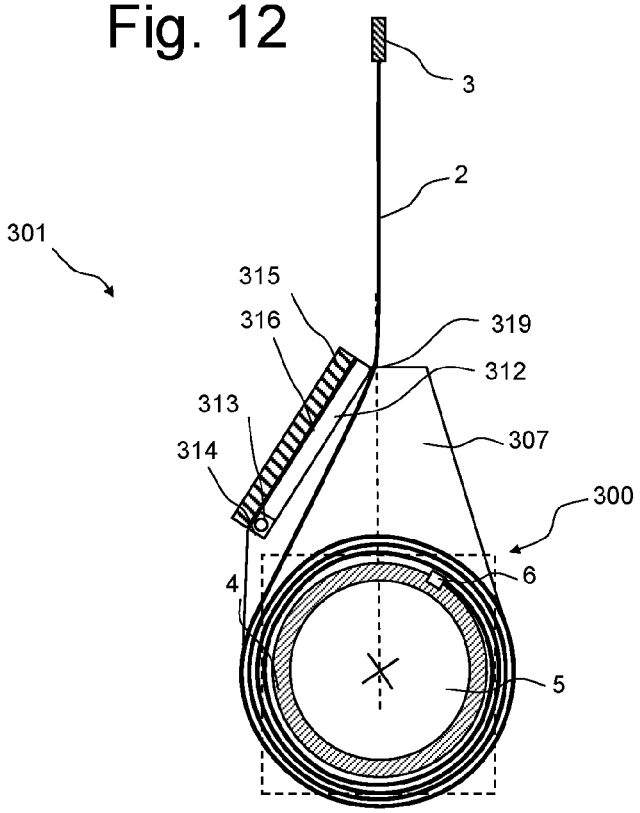
FIG. 12 shows a cross section of a fifth embodiment of the window covering device or projection screen device according to the invention.
Figure 13:
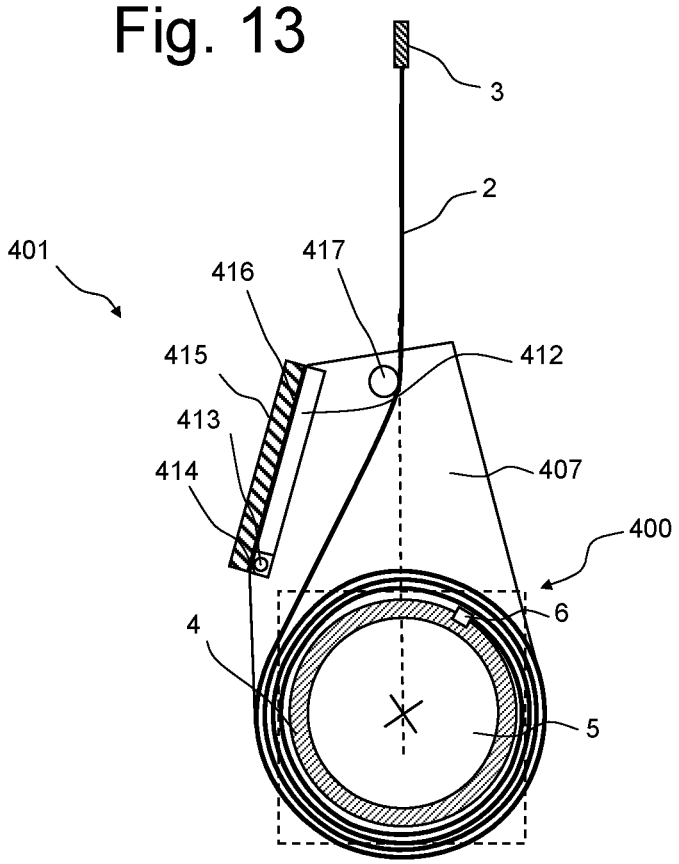
FIG. 13 shows a cross section of a sixth embodiment of the window covering device or projection screen device according to the invention.

In FIGS. 11 to 13, with the aim of simplification, the angle β has not been shown in contrast to the representation in FIG. 6. Such an angle, which is variable according to the degree of unwinding of the canvas, also exists in the embodiments of FIGS. 11 to 13.

Thus, in the embodiments in FIGS. 11 to 13, the rod 417, the bar 312 or the section 212 provides the same function as the roller 9*a* of the embodiments in FIGS. 4 to 6. However, the rod 417, the bar 312 or the section 212 acts by friction along the canvas when said canvas is wound or unwound whilst the roller 9*a* acts by rolling along the canvas when said canvas is wound or unwound.

In the different embodiments and more generally in any device according to the invention, the structure of the motorized device allows for the use of a winding tube which has a low level of rigidity. For example, the material comprising the winding tube can be characterized by a Young's modulus of less than or equal to 20 GPa, preferentially of between 3 and 15 GPa inclusive. This also allows for the use of winding tubes in plastics material, the thickness of which varies between 1 and 5 mm.

Moreover, in the different embodiments, it is advantageous to use an end-plate which realizes the function of supporting the torque compensating means vis-à-vis the winding tube and covers the ends of the canvas wound on the winding tube.

Apart from its aesthetic function, said end-plate can also have one or several of the following functions:

- passage and protection of a cable connecting a photovoltaic panel to a battery unit which is housed in the winding tube,
- support of the photovoltaic panel
- fixing of an electronic unit, for example in the form of a printed circuit, for example allowing the battery charge to be managed,
- protection of the edges of the canvas.

Said end-plate can be clipped or press-fitted to avoid any assembly by connecting means such as screws which are visible from the outside. If said end-plate is sufficiently rigid, it is not necessary, for example, for it to be screw-connected to the bearing of the winding tube, axial stresses being low. Thus, the end-plate can have a smooth outer surface. It can be in specific forms which allow it to realize the different functions shown above, such as, for example, jaws or excrescences. Thus, by means of simple folding, it can, for example, be inserted into a hollow bar which serves as torque compensation means, such as described in connection with FIG. 12.

In all the embodiments, a photovoltaic-type panel allows the element to be made totally autonomous if it is disposed in a lit room and in particular in front of a picture window. In other cases, the storage means is a primary battery, for example an alkaline-type or lithium-type battery. It is also possible to combine an energy storage provided from a photovoltaic panel with a storage provided from a primary battery.

One very significant advantage of the invention is to be able to absorb in a very significant manner any structure-borne-type vibratory transmission between the motor and the frame, said transmission only being able to take place through the canvas. As a result, a motorized movable screen according to the invention is particularly quiet when the motor is operating. In the different embodiments and more generally in any device according to the invention, said transmission can also be limited by providing resilient means at the bearings for guiding the winding tube. For example, the device can include annular bands between the lateral elements and the winding tube.

The invention is therefore not restricted to autonomous-type applications and it is also possible to use it with a flexible wire link in order to supply the motors and thus to have the benefit of the acoustic advantage.

The structure of the window covering device or projection screen device according to the invention allows it to be easily and aesthetically set up whatever the geometry of the structure of the building in its fixing zone. In particular, the device can be set up easily on non-straight and horizontal opening lintels, such as lintels which have a curved form or sloping lintels.

The term "at least approximately at right angles", means "at right angles" or "approximately at right angles".

The invention claimed is:

1. A motorized operating interior device for operating a movable interior screen with a windable canvas of a window covering device or of a screen device for covering a window of a building, the motorized operating interior device being suspended from the canvas and including:

- a winding tube which is movable around a first axis for winding the canvas thereon,
  - an actuator which is disposed at least in part in the winding tube,
- a first element for fixing a first end of the canvas to the winding tube, a weight of the winding tube, actuator, and canvas wound on the winding tube creating a canvas unwinding torque,
- a compensating element for compensating for the canvas unwinding torque, the compensating element disposed between the canvas and the window and not in contact with the canvas; and
- wherein a mass of the compensating element creates a force that acts on the winding tube to create a compensating torque counter to counterbalance the unwinding torque,
- wherein the motorized operating interior device is connected to the building solely by the canvas.

2. The motorized operating interior device according to claim 1, wherein the compensating element is angled with respect to a vertical plane of the canvas to cause the winding tube to move away from the window or frame.

3. A motorized operating interior device for operating a movable interior screen with a windable canvas of a window covering device or of a screen device for covering a window of a building, the motorized operating interior device being suspended from the canvas and including:

a winding tube which is movable around a first axis for winding the canvas thereon, an actuator which is disposed at least in part in the winding tube, a first element for fixing a first end of the canvas to the winding tube, a weight of the winding tube, actuator, and canvas wound on the winding tube creating a canvas unwinding torque, a compensating element for compensating for the canvas unwinding torque, the compensating element disposed between the canvas and the window and bearing on the canvas, the compensating element acting on the winding tube to create a compensating torque to counterbalance the unwinding torque; and a distance-piece to hold the canvas and the motorized operating interior device being suspended from the canvas at a top end a distance from the window or a window frame, a length of the distance-piece being such to enable the canvas to unwind without any contact with the window or window frame.

4. A motorized operating interior device for operating a movable interior screen with a windable canvas of a window covering device or of a screen device for covering a window of a building, the motorized operating interior device being suspended from the canvas and including:

a winding tube which is movable around a first axis for winding the canvas thereon, an actuator which is disposed at least in part in the winding tube, a first element for fixing a first end of the canvas to the winding tube, a weight of the winding tube, actuator, and canvas wound on the winding tube creating a canvas unwinding torque, a compensating element for compensating for the canvas unwinding torque, the compensating element disposed between the canvas and the window and bearing on the canvas, the compensating element acting on the winding tube to create a compensating torque counter to counterbalance the unwinding torque, wherein the motorized operating interior device is connected to the building solely by the canvas, and wherein there is no contact between the motorized operating interior device and the building when the actuator operates to wind or unwind the canvas on the winding tube.

5. The motorized operating interior device according to claim 4, wherein the motorized operating interior device is adapted to be in contact or in connection with just the canvas.

6. The motorized operating interior device according to claim 4, wherein the winding tube is made from plastics material.

7. The motorized operating interior device according to claim 4, wherein said motorized device includes a second element for fixing a second end of the canvas to the compensating element for compensating for the canvas unwinding torque.

8. The motorized operating interior device according to claim 4, wherein the compensating element includes a cylindrical section surrounding the winding tube, the cylindrical section having an opening substantially parallel to the first axis in which the canvas engages and an edge of the cylindrical section bears against the canvas to apply the compensating torque.

9. The motorized operating interior device according to claim 4, comprising:

a distance-piece to hold the canvas and the motorized operating interior device being suspended from the canvas at a top end a distance from the window or a window frame, a length of the distance-piece being such to enable the canvas to unwind without any contact with the window or window frame.

10. The motorized operating interior device according to claim 4, wherein the compensating element includes at least one lateral element connected on the outside of the winding tube and a bar connected to the lateral element, and wherein the bar includes at least one edge that bears against the canvas to apply the compensating torque.

11. The motorized operating interior device according to claim 10, comprising a photovoltaic panel fixed on the bar.

12. A window covering device or screen device including a motorized interior operating device according to claim 4 and a movable interior screen which includes a canvas.

13. The motorized operating interior device according to claim 12, wherein said device includes a second element for fixing a second end of the canvas to a fixed frame.

14. The motorized operating interior according to claim 12, wherein said motorized operating interior device includes a canvas return tube, the return tube being freely rotatable around a third axis which is parallel to the first axis.

15. The motorized operating interior device according to claim 4, wherein the actuator includes a first part and a second part which rotate with respect to one another along the first axis when the actuator is activated and are blocked with respect to one another when the actuator is not activated, the first part rotating integrally with the winding tube and the second part being connected to the compensating element.

16. The motorized operating interior device according to claim 15, wherein the second part includes an output shaft of the actuator.

17. The motorized operating interior device according to claim 15, wherein the second part is a housing of the actuator.

18. The motorized operating interior device according to claim 15, wherein the compensating element includes at least one lateral element, which is connected to the second part on the outside of the winding tube and extends approximately at right angles to the first axis over a distance which is greater than the winding radius of the canvas when the canvas is completely wound on the winding tube.

19. The motorized operating interior device according to claim 18, wherein said motorized operating interior device includes a resilient element at the bearings for guiding the winding tube.

20. The motorized operating interior device according to claim 18, wherein the lateral element includes an end-plate.

21. The motorized operating interior device according to claim 18, wherein the compensating element includes a roller, which is mounted on a free shaft so as to be movable around a second axis which is parallel to the first axis, and is connected to the lateral element at a distance from the first axis which greater than the winding radius of the canvas when the canvas is completely wound on the winding tube, the roller being in roller contact with an outside surface of the canvas, at least when the actuator is not activated and the canvas unwinding torque being at least counterbalanced by the force of the canvas on the movable roller.

22. The motorized operating interior device according to claim 21, wherein the compensating element includes an additional mass which is connected to a lateral element at a distance from the first axis which is greater than the winding radius of the canvas when the canvas is completely wound on the winding tube, the compensating torque for the canvas unwinding torque being the torque created by the weight of the lateral element and of the additional mass.

23. The motorized operating interior device according to claim 22, wherein the additional mass includes a photovoltaic-type panel.

24. The motorized operating interior device according to claim 22, wherein the additional mass includes a store of energy.

25. The motorized operating interior device according to claim 18, wherein the lateral element is fixed to an approximately cylindrical section along a radius which is greater than the winding radius of the canvas when the canvas is completely wound on the winding tube, wherein the lateral element surrounds the unwinding tube and is provided with a slot which is parallel to the first axis.

26. The motorized operating interior device according to claim 25, wherein the section includes an edge adapted to frictively abut against the canvas.

27. The motorized operating interior device according to claim 26, wherein said motorized device includes a photovoltaic panel which is fixed on the section.

28. The motorized operating interior device according to claim 26, wherein the section includes a channel for guiding an electric cable.

29. The motorized operating interior device according to claim 18, wherein said motorized operating interior device includes a bar which is fixed to the lateral element.

30. The motorized operating interior device according to claim 29, wherein the bar includes an edge adapted to frictively abut against the canvas.

31. The motorized operating interior device according to claim 29, wherein said motorized operating interior device includes a photovoltaic panel which is fixed on the bar.

32. The motorized operating interior device according to claim 29, wherein the bar includes a channel for guiding an electric cable.

33. The motorized operating interior device according to claim 29, wherein said motorized operating interior device includes a rod which is fixed to the lateral element, the rod adapted to frictively abut against the canvas.

* * * * *